US005657496A

United States Patent [19]

Corb et al.

[11] Patent Number: 5,657,496

[45] Date of Patent: Aug. 19, 1997

[54] TWO-AXIS ROTATING HYDROTHERAPY JET WITH ADJUSTABLE NOZZLE ORIENTATIONS

[75] Inventors: Richard P. Corb, Simi Valley; Eugene M. Gravatt, Valencia; Robert Spears, Chatsworth, all of Calif.

[73] Assignee: B&S Plastics, Inc., Oxnard, Calif.

[21] Appl. No.: 597,116

[22] Filed: Feb. 6, 1996

Related U.S. Application Data

[63] Continuation of Ser. No. 279,447, Jul. 25, 1994, abandoned, which is a continuation-in-part of Ser. No. 197,616, Feb. 17, 1994, Pat. No. 5,353,447, which is a continuation-in-part of Ser. No. 970,638, Nov. 2, 1992, abandoned.

[51] Int. Cl.[6] ..... A61H 33/00

[52] U.S. Cl. ..... 4/541.6; 239/587.1

[58] Field of Search ..... 4/541.1, 541.3, 4/541.4, 541.6; 239/416.4, 416.5, 417.3, 423, 424, 428.5, 587.1

[56] References Cited

U.S. PATENT DOCUMENTS

| | | | |
|---|---|---|---|
| 3,868,949 | 3/1975 | Arneson | 4/541.6 X |
| 4,692,950 | 9/1987 | Henkins et al. | 4/541.6 |
| 5,271,561 | 12/1993 | Tobias et al. | 239/289 |
| 5,291,621 | 3/1994 | Mathis | 4/541.4 |

FOREIGN PATENT DOCUMENTS

| | | | |
|---|---|---|---|
| 3820349 | 12/1989 | Germany | 4/541.6 |

*Primary Examiner*—Robert M. Fetsuga
*Attorney, Agent, or Firm*—Koppel & Jacobs

[57] ABSTRACT

An adjustable rotating hydrotherapy jet that rotates around primary and secondary rotation axes and includes a housing, a water inlet to the housing, and a water nozzle within the housing that forms water flowing through the inlet into a drive jet. A primary outlet is rotatably mounted on the housing about a primary rotation axis and holds the outlet downstream from the water nozzle to receive the jet flow and discharge the flow along an outlet axis. The jet flow through the primary outlet imparts a turning moment to the outlet, causing it to rotate relative to the primary rotation axis and discharge a first stage jet. A secondary outlet is rotatably mounted on the primary outlet about a secondary rotation axis to receive the jet flow from the primary outlet. The jet flow imparts a turning moment to the secondary outlet that causes it to rotate relative to the secondary rotation axis and discharge a second stage jet. The orientation of the primary outlet is adjustable with two degrees of freedom so as to adjust the orientation between the outlet and primary rotation axes, and thereby provide user control over both the outlet flow angle, coverage area and the speed of rotation.

20 Claims, 5 Drawing Sheets

FIG. 5
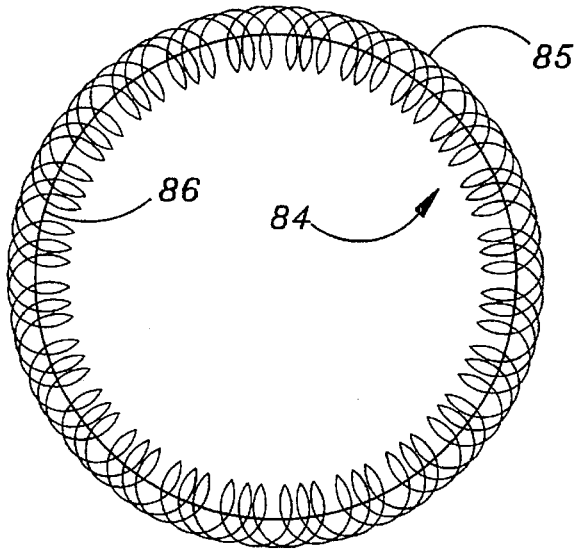
FIG. 6a
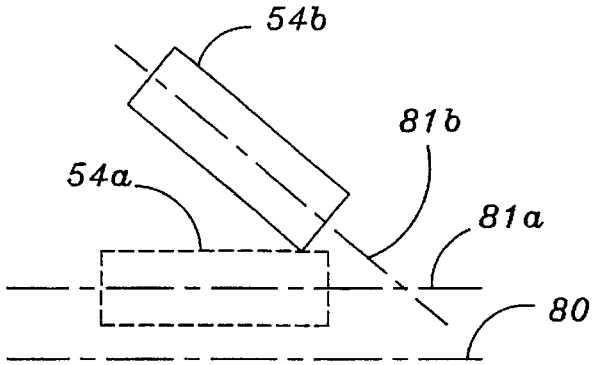
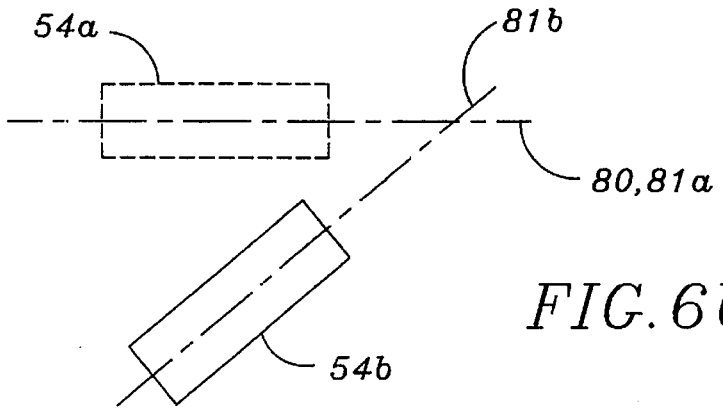
FIG. 6b

TWO-AXIS ROTATING HYDROTHERAPY JET WITH ADJUSTABLE NOZZLE ORIENTATIONS

RELATED APPLICATION

This application is a continuation of application Ser. No. 08/279,447, filed Jul. 25, 1994, abandoned which is a continuation-in-part of application Ser. No. 08/197,616 filed Feb. 17, 1994 and issued Oct. 11, 1994 as U.S. Pat. No. 5,353,447 entitled "A ROTATING HYDROTHERAPY JET WITH ADJUSTABLE OFFSET OUTLET NOZZLE," which is a continuation-in-part of application Ser. No. 07/970,638, filed Nov. 2, 1992, abandoned.

BACKGROUND OF THE INVENTION

1. Field of the Invention

This invention generally relates to rotating hydrotherapy jets, and more specifically to two-bearing drive rotating hydrotherapy jets with adjustable nozzle orientations.

2. Description of the Related Art

Various hydrotherapy jets have been developed in the past, for use in spas, hot tubs and bathtubs, that discharge an aerated stream of water in a rotating pattern. Such jets have been found to produce a pleasing massaging effect for many users, and have become quite popular. Representative rotating jets are disclosed in U.S. Pat. Nos. 4,763,367, 4,715,071, 4,692,950, 4,523,340, 4,339,833, 4,220,145 and 3,868,949. B & S Plastics, Inc., the assignee of the present invention, has also produced rotating jets designated as Model Nos. 213-1260, 213-1270, 213-2760 and 213-3760.

The prior rotating jets generally employ either a long discharge tube with an in-line inlet that receives a jet flow from a venturi nozzle and a remote outlet that is off-axis and follows a track around an outlet plate, or a rotating discharge plug that includes an angled jet discharge conduit and is held in place by a retaining pin at its forward end.

Such designs require additional parts for the rotation feature that obstruct or restrict the output flow from the jet, and also present an appreciable resistance to rotation that further reduces the output rate. In addition, neither the angle at which the water/air flow is injected into the spa and thus the area covered by the jet, or the rotational speed can be adjusted. These types of adjustment features would be highly desirable, but are incompatible with existing designs. Furthermore, the prior jets rotate on a single axis which limits the coverage area and massaging effects of the jet.

SUMMARY OF THE INVENTION

The present invention seeks to provide a rotatable hydrotherapy jet that is simple in design and can be easily fabricated using conventional molding techniques, provides primary and secondary rotation axes to increase the coverage area and improve the massaging effect of the jet, provides easy user-operated controls over the rotational speed, output flow angle and coverage area, plus an option for inhibiting rotation about the primary axis, and achieves a less obstructed flow and freer rotation than prior rotatable jets.

These goals are achieved with a new jet that rotates around primary and secondary rotation axes. The jet includes a housing, a water inlet to the housing, a water nozzle within the housing that forms water flowing through the inlet into a drive jet, and a primary outlet that is rotatably mounted on the housing about a primary rotation axis which holds the outlet downstream from the water nozzle to receive the drive jet and discharge a first stage jet along an outlet axis. The jet flow through the primary outlet imparts a turning moment to the outlet, causing it to rotate relative to the primary rotation axis and discharge the first stage jet. A secondary outlet is rotatably mounted on the primary outlet about a secondary rotation axis to receive the jet flow from the primary outlet. The jet flow imparts a turning moment to the secondary outlet that causes it to rotate relative to the secondary rotation axis and discharge a second stage jet.

In the preferred embodiment the orientation of the primary outlet is adjustable with two degrees of freedom, allowing the angle between the outlet and primary rotation axes to be adjusted and thereby provide user control over the outlet flow angle, the coverage area and the speed of rotation. The orientation adjustment range preferably includes a setting at which the primary outlet axis is parallel to the primary rotation axis, and thus adds a non-rotational mode to the first stage.

BRIEF DESCRIPTION OF THE DRAWINGS

FIG. 5 shows a jet discharge pattern for the orientations shown in FIGS. 1 and 4;

Figure 7:
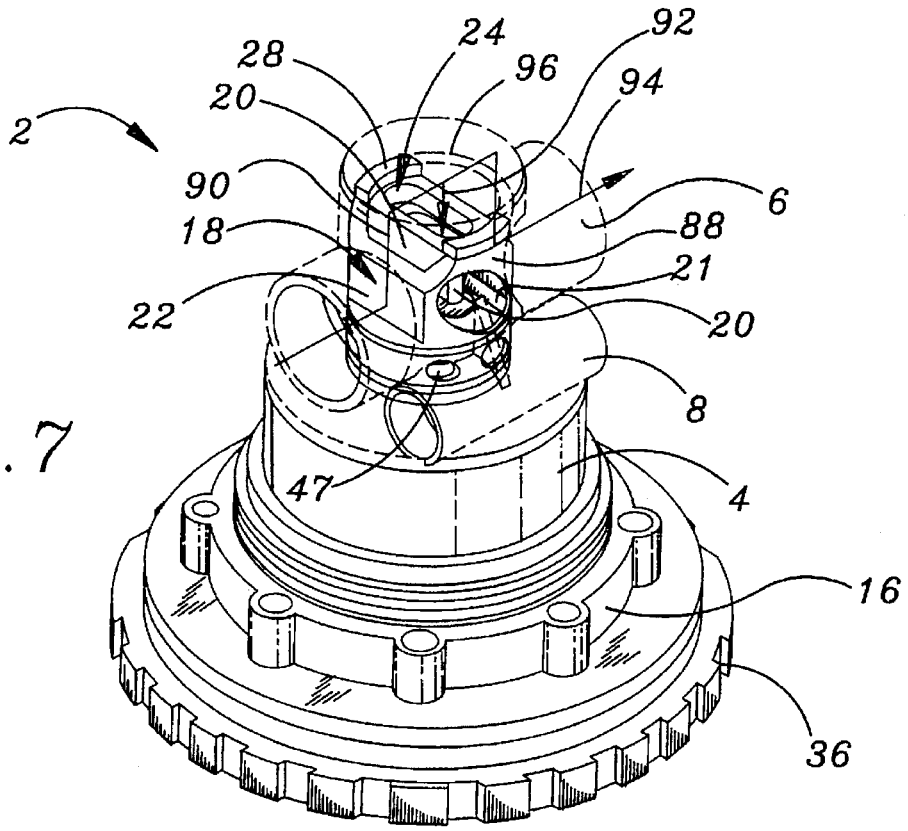
Figure 8:
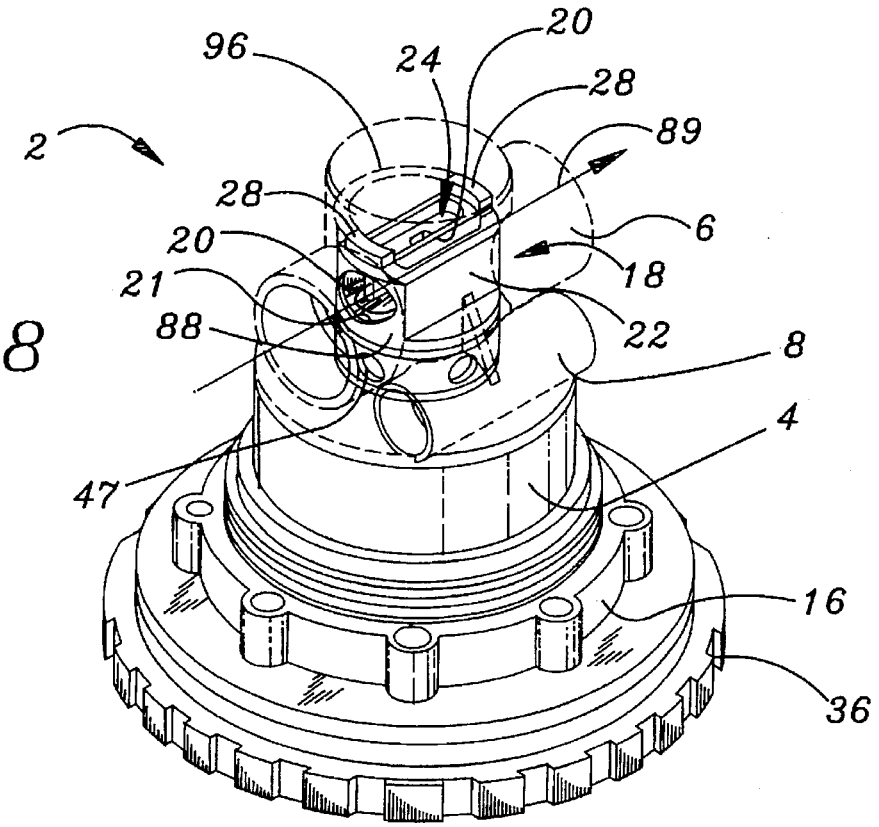

FIGS. *6a* and *6b* are projections of the 3-D orientations for the primary outlet nozzle onto a common plane defined by the primary rotation and outlet axes, and onto a plane that is perpendicular to the common plane and includes the outlet axis, respectively;

FIG. 7 is a perspective view of the mechanism for controlling the flow of water through the jet, with the mechanism adjusted to produce a jet discharge; and FIG. 8 is a perspective view similar to FIG. 7, but with the flow control mechanism rotated 90° to prevent a jet discharge.

DETAILED DESCRIPTION OF THE INVENTION

Figure 1:
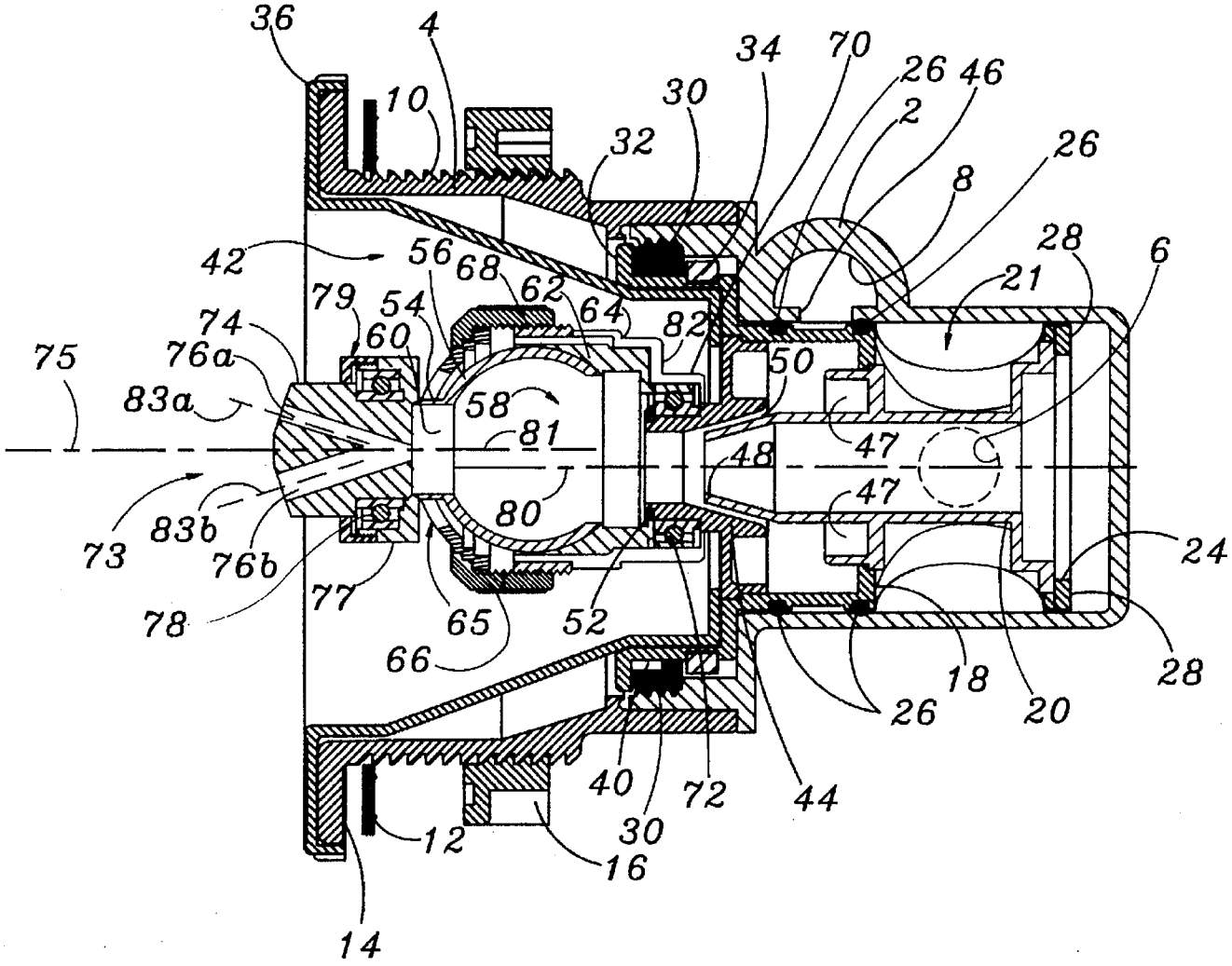
FIG. 1 is a sectional view of a rotatable hydrotherapy jet in accordance with the invention.
Figure 2:
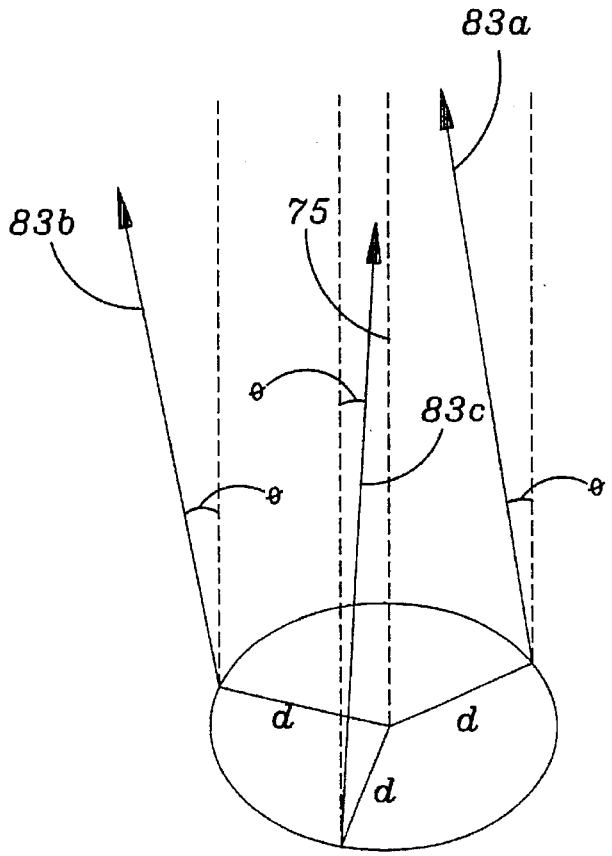
FIG. 2 is a perspective view of the rotation and outlet axes for a tri-hole pulsator that can be used as a secondary outlet.
Figure 3:
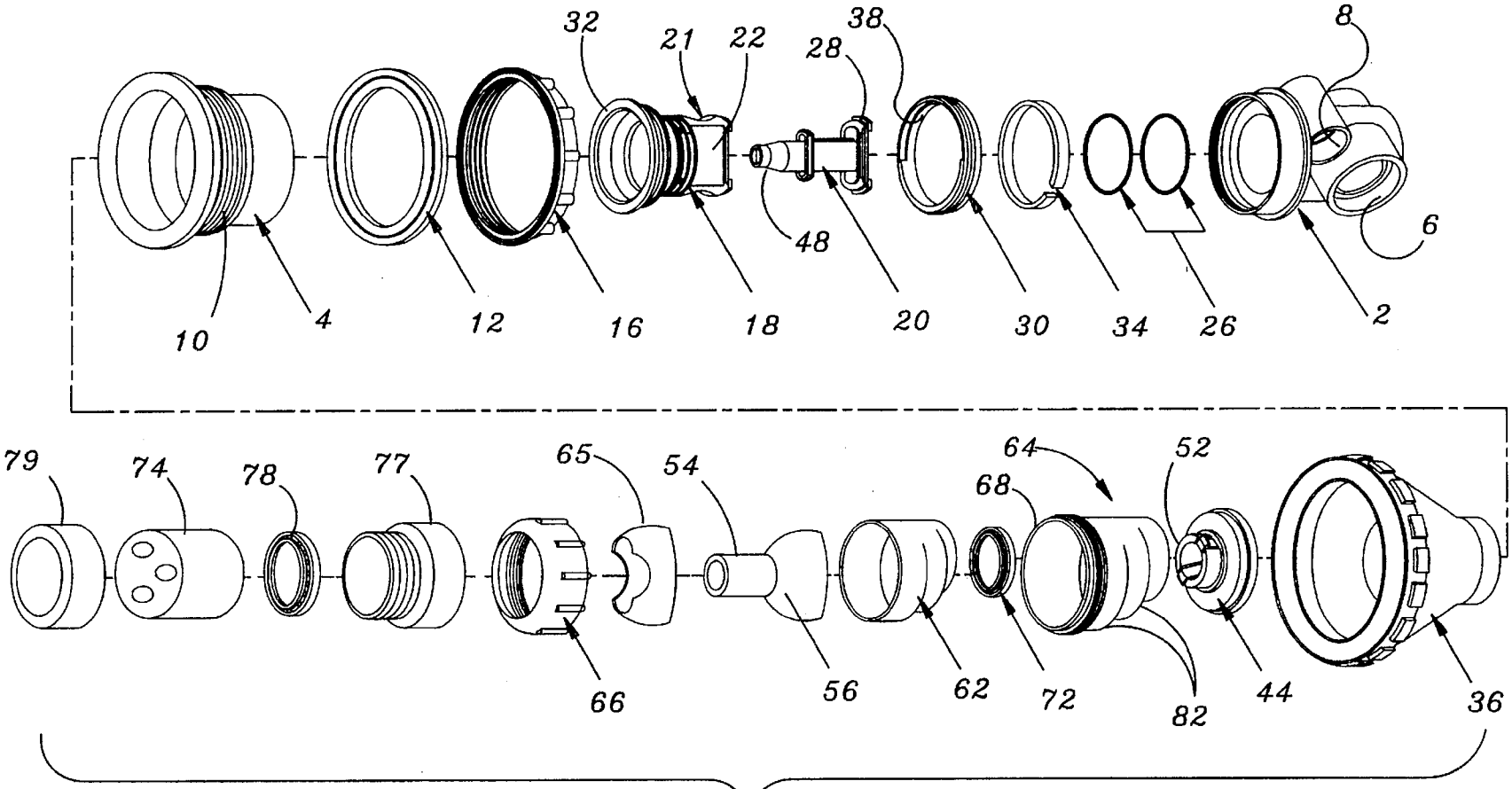
FIG. 3 is an exploded perspective view of the jet shown in FIG. 1.

A rotational hydrotherapy jet that is constructed in accordance with the invention is shown in FIGS. 1–3. The jet is enclosed within a housing that consists of a rear body portion 2 that mates with a front body portion 4. The rear body portion includes water and air conduits 6 and 8 that allow for a flow of water and air through the rear of the jet, transverse to the jet axis. The water and air conduits include sockets at either end to receive tubing from adjacent jets in a common water and air supply system for a series of jets. The front body portion 4 includes an exterior threading 10, with a gasket 12 adjacent a front flange 14 at the forward end of the threading, and a nut 16 screwed onto the threading to the rear of the gasket. The jet is held in place, protruding through an opening in the wall of a spa or tub, by sandwiching the spa or tub wall surrounding the opening between the gasket 12 and nut 16, and tightening the nut.

A diverter element 18 is positioned within the rear portion of the housing, and retains an interior water nozzle 20. The diverter can be rotated, along with its held water nozzle, through an arc of about 90° to adjust the volume of water discharged out from the jet. For this purpose it includes a cylindrical bypass opening 21 towards its rear end that is bounded by a pair of opposed side walls 22 with flat exterior surfaces (see FIG. 3). The nozzle width (into the page in FIGS. 1 and 3) is less than the diameter of the bypass opening 21, leaving space on either side of the nozzle for water to flow through the opening. When the diverter is positioned at one end of its rotational limit, as shown in FIG. 1, the walls 22 are perpendicular to the water conduit 6, causing water entering through the conduit to deflect rearward and to enter the water nozzle 20 through an opening 24 at the back of the nozzle. When the diverter 18 is rotated 90° the bypass opening 21 is aligned with the interior of the water conduit 6, and water entering from one end of the conduit continues to flow through the opening 21 (around both sides of the nozzle 20 that extends across the opening) and out the other end of the water conduit, without being discharged through the jet. Intermediate levels of water flow out of the jet can be established by rotating the diverter to intermediate positions between the limits of its rotation. A further description of the flow control mechanism is provided below in connection with FIGS. 7 and 8.

A pair of O-rings 26 are lodged in grooves in the diverter's exterior surface and bear against the inner housing wall to facilitate the diverter's rotation, and also to restrict air entering through air conduit 8 to a desired path through the jet. The nozzle includes a pair of opposed flange sections 28 at its rear that are seated on the rear surface of the diverter.

The diverter is held within the housing by a retainer ring 30, which is secured just to the rear of a forward diverter flange 32 by means of a snap ring 34. The rotational position of the diverter is controlled by means of a face plate 36 that overlaps the front end of the jet housing, and extends back into the interior of the housing to engage the diverter along a broad surface contact. The face plate 36 can be easily grasped by the user and rotated to adjust the water flow. The 90° rotational limit is set by means of a keyway 38 in the interior surface of the retainer ring 30, and a mating key 40 on the exterior of the diverter.

The forward portion of the jet housing and the face plate 36 form a large cavity 42 which opens to the front of the jet, and the rotating elements of the jet are located within this cavity. An air nozzle 44 spans the forward end of the diverter 18, and directs a flow of air that enters the jet through an opening 46 below the air conduit 8. The air flows around the exterior of the diverter 18 which is slightly recessed in this area for this purpose, and into the interior of the diverter through openings 47. The water nozzle 20 includes a slightly tapered orifice 48 that accelerates the water flowing through the nozzle into a venturi jet. The interior surface of the air nozzle 44 is slightly offset from the exterior of the water orifice 48, leaving a passageway 50 through which air can flow to the forward end of the water nozzle. At that location the air is entrained into the water jet due to the venturi action, causing a desirable water/air mixture to be emitted from the jet.

The air nozzle 44 includes a boss 52 that extends into the cavity 42 and acts as a stator for the rotating outlet. A primary outlet nozzle is preferably provided as the tubular outlet 54 of an eyeball-type fitting. This fitting includes a ball portion 56 that is integrally formed with the outlet tube 54, with a large opening 58 formed at the rear of the ball portion and a cylindrical opening 60 through the outlet tube 54. The eyeball piece is rotatably lodged in a socket that consists of a wear ring 62, and a mounting support member 64 within which the wear ring 62 is captured.

In the original application, Ser. No. 07/970,638, the water nozzle tapers to a relatively small outlet orifice, e.g. approximately 7.9 mm. The small orifice constrains the water flow to a level substantially less than the flow through water conduit 8, and creates a back pressure of approximately 12–14 psi in the water line connected to the jet. The back pressure is used to drive other hydrotherapy jets in the spa and produces a volatile action in the jet flowing through the primary outlet. Accordingly, the eyeball is fitted with a number of detents that hold it in the desired position. In the two-bearing drive jet the water nozzle is substantially cylindrical with only a slight taper to an orifice of approximately 12.7 mm, and provides a larger flow to drive the secondary rotating jet. Consequently, the back pressure around the eyeball fitting is lower, approximately 5 psi, and the outlet nozzle can be positioned without detents. The outlet tube 54 extends through a turret 65 that has an asymmetrical clover shape (see FIG. 4) and provides a plurality of positions for orienting the outlet tube with two degrees of freedom to define the jet angle, coverage area and rotation speed. The outlet tube can be placed in the turret positions or at any intermediary position in accordance with the operator's preferences.

The eyeball outlet 56 and turret 65 are held in place against the wear ring 62 by means of a threaded retainer 66 that screws over an exterior threading 68 at the forward end of the mounting support member 64, with the eyeball piece held in place between the wear ring 62 and retainer 66. A ring 70 is formed at the rear of the mounting support member 64 and is positioned around the stator 52, separated from the stator by a ball bearing 72 that allows for a very low friction rotation of the mounting support member around the stator.

A secondary outlet is preferably a tri-hole pulsator 73, and is attached to the end of outlet tube 54. The pulsator includes a nozzle 74 with a rotation axis 75, and three conduits **76*a*, 76*b* and 76*c* spaced at 120° intervals around the rotation axis. As shown in FIG. 2, the respective outlet axes 83*a*–83*c* of conduits 76*a*–76*c* are offset by a distance (preferably about 2.5 mm) from the rotation axis 75 and are oriented at an Θ (preferably about 17°) to the axis 75 in a plane perpendicular to the offset. Alternatively, single, dual or other multiple conduit nozzles can be used. A male retaining ring 77 is attached around the outer surface of outlet tube 54 and receives nozzle 74. A ball bearing 78 is positioned between the nozzle 74 and the male retaining ring 77. A female retaining ring 79 threads onto the male retaining ring 77** to hold the nozzle and bearing in place, allowing for a very low friction rotation of the nozzle around its axis.

The geometric relationship between the eyeball piece and the rest of the jet is best seen in FIG. 1, in which the stator 52 and ball bearing 72 provide a rotation axis 80 for the mounting support member 64. This rotation axis is preferably coaxial with the axis of the water nozzle 20, although if desired the water nozzle can be offset somewhat. However, the eyeball outlet tube 54 has an axis 81 that is offset from, not coincident with, the rotation axis 80. This is accomplished by providing the mounting support member 64 and wear ring 62 with a series of steps 82 on one lateral side but not on the other. When the eyeball is positioned with its axis 81 parallel to the rotation axis 80, as illustrated in FIG. 1, the two axes 80 and 81 lie in a common plane (the plane of the page), and are parallel but offset from each other. The rotation axis 75 of the tri-hole pulsator is preferably coaxial with outlet axis 81. The pulsator outlet axes **83*a*–83*c*** are offset from and at non-intersecting orientations to the rotation axis to provide a turning moment to the pulsator in response to the jet flow.

With the eyeball positioned as shown in FIG. 1, the water/air flow through its outlet tube 54 will not produce any rotational thrust around the ball bearing 72. However the jet flowing through the off-axis conduits in the pulsator will produce a rotational thrust around ball bearing 78, causing nozzle 74 to rotate around rotation axis 75. If the position of the eyeball outlet is adjusted by rotating it within its socket so that its outlet axis 81 is not parallel to the rotation axis 80, the jet flow through the eyeball outlet will produce a counter-thrust that has a component directed into the page of FIG. 1. Since this thrust component is offset from and perpendicular to the rotation axis 80, it produces a turning moment that causes the eyeball outlet and its mounting structure to rotate around the ball bearing 72 and discharge a first stage jet along the outlet axis 81, which rotates around the rotation axis 80. The thrust component increases with the angle of the eyeball outlet such that the outlet's rotational speed is greater for larger radii. The first stage jet flows through pulsator 73, imparting a turning moment that causes the nozzle 74 to rotate about its rotation axis 75 and discharge second stage jets through conduits 76*a*–76*c*. The conduits 76*a*–76*c* are preferably bored at a sufficiently large angle such that the pulsator rotates faster than the primary outlet. Alternatively, the conduits could be bored at a smaller angle such that the secondary rotation is slower than the primary rotation.

The respective turning moments are maintained as the primary and secondary outlets rotate about their respective rotational axes, continuing the rotations for as long as the eyeball is kept in the same position with respect to its mounting structure and water continues to flow out through the jet. The eyeball position can be easily adjusted by first rotating the face plate 36 to shut off the flow of water through the jet, and then restarting the water flow after the adjustment has been made.

So long as the eyeball is not rotated to a position at which its axis 81 intersects or is parallel to the rotation axis 80, the jet flow will produce a counter-thrust that has a component which causes the eyeball structure to rotate. A maximum rotational force is obtained when the eyeball is moved in a direction perpendicular to the common plane of the eyeball and rotation axes 81 and 80 shown in FIG. 1. Therefore, for a given orientation of outlet axis 81 that defines the rotational radius, the maximum rotational speed is achieved by adjusting the orientation of the eyeball in the perpendicular plane. The rotational speed can be adjusted lower by orienting the eyeball away from the perpendicular plane to decrease the thrust component. By providing two degrees of freedom for adjusting the orientation of the eyeball, the jet discharge angle, rotational radius and speed can be easily controlled to provide an improved massaging effect. Changing the specific design of the eyeball and primary nozzle, and tri-hole pulsator will change the respective rotational speeds. The speeds are also a function of the available flow rate and water pressure provided to the jet.

Figure 4:
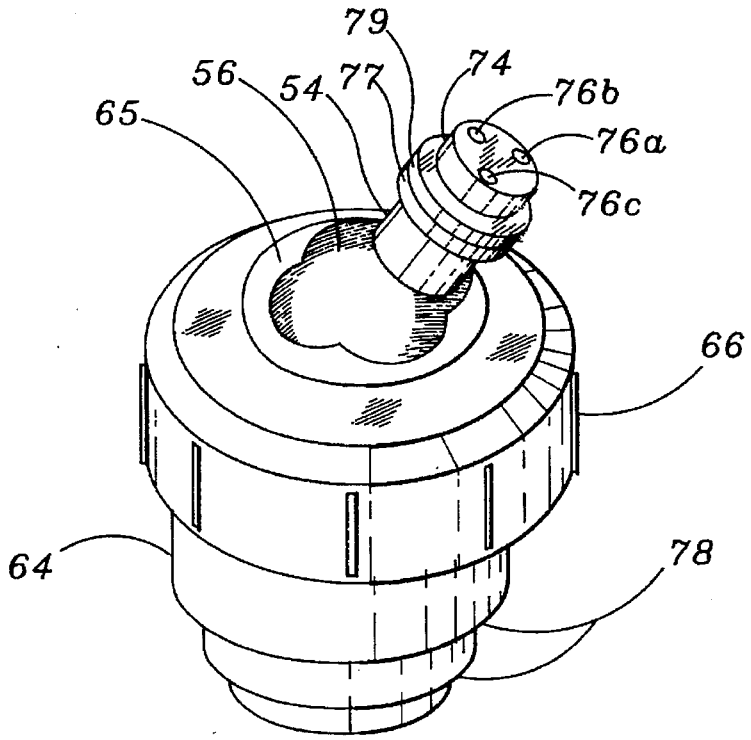
FIG. 4 is a perspective view showing the primary outlet orientation adjustment.

FIG. 4 shows the eyeball outlet assembled in its support structure, with its adjustment guided by the turret 65. FIG. 5 shows a jet discharge pattern 84 comprised of three relatively small high speed circular patterns 85 associated with the tri-hole pulsator, superimposed over the larger lower speed circular pattern 86 traced out by the primary outlet nozzle. The coverage area of pattern 84 is larger than the pattern provided by just the primary outlet nozzle, and thus provides an improved massaging effect. Furthermore, the three small bore outlet jets provide an improved massaging effect.

FIG. 6*a* is a projection of the 3-D orientations for the primary outlet nozzle 54 onto a common plane defined by the primary rotation and outlet axes, while FIG. 6*b* is a projection onto a plane that is perpendicular to the common plane of FIG. 6*a* and also includes the primary outlet axis. In these figures only the eyeball outlet nozzle 54, its axis 81 and the rotation axis 80 are shown. In its position 54*a* the outlet nozzle's axis 81*a* is parallel to the rotation axis 80 (the position shown in FIG. 1), and the jet does not rotate. When the outlet nozzle is adjusted to the position 54*b* (the position shown in FIG. 4), representing an angle of approximately 20° to both the common and perpendicular planes, its axis 81*b* is no longer parallel to the rotation axis 80, but it still does not intersect the rotation axis. A rotational moment is thus developed that causes the jet to rotate about axis 80.

It can be seen that the jet flows unobstructed through the eyeball outlet and is discharged by the pulsator into the spa or bathtub. The ability to easily adjust the position of the eyeball outlet relative to its support structure allows the user to select whatever rotational speed and jet angle are most pleasing to her or him, and also to select a non-rotating operation if desired.

FIGS. 7 and 8 present a perspective view of the mechanism which controls the volume of water discharge from the jet. The rear body portion 2, water conduit 6 and air conduit 8 are shown in phantom lines so that the diverter 18 can be seen.

The bypass opening 21 in diverter 18 permits water flowing in from one end of the water conduit to continue flowing out the other end of the conduit when the diverter is rotated to align the opening 21 with the water conduit, as in FIG. 8. The diverter face 88 through which the opening 21 is formed is rounded to match the inner diameter of the rear body portion 2, and has a sufficiently large area to prevent water from flowing around the sides of the diverter when it is in the position of FIG. 8. Thus, in FIG. 8 all of the water that enters the water conduit 6 continues on through the bypass opening 21 and exits the jet through the opposite end of the conduit 6, with no water discharged through the jet. This is indicated by the water flow arrow 89.

The nozzle 20 extends from the rear of the diverter 18, through the center of the diverter's bypass opening 21, and into the discharge portion of the jet (not shown), where it is tapered to the discharge orifice 48 shown in FIG. 1. The elongate opening 24 at the rear of the nozzle receives water when the diverter is rotated to the position shown in FIG. 7. The nozzle is narrow enough that it occupies only the central portion of the diverter bypass opening 21, leaving a clearance for water to flow around both sides of the nozzle in the position of FIG. 8.

When a full jet discharge is desired, the face plate 36 is adjusted to rotate the diverter to the FIG. 7 position. In this position the flow of water from the inlet water conduit 6 is diverted by the diverter side wall 22 so that it flows towards the rear of the diverter, as indicated by arrow 90. Some of the water enters the nozzle through its rear opening 24, as indicated by arrow 92; the rest of the water continues flowing past the rear of the nozzle and diverter and out through the opposite end of the water conduit 6 to the remaining jets in the spa, as indicated by arrow 94. (The last jet in line will have the outlets from its water and air conduits capped, and for this jet there will be no water outflow 94).

Intermediate water discharges between fully on and fully off are established by rotating the diverter to intermediate positions between those shown in FIGS. 7 and 8. In the intermediate positions a portion of the inlet water flows through the bypass opening 21 to bypass the nozzle, and the remainder is diverted to the area of the nozzle opening 24. Air is admitted into the jet discharge through the openings 47 in the exterior diverter wall for all of the diverter orientations.

If it is desired to direct all of the inlet water flow into a single powerful jet discharge, rather than leaving some for downstream jets, the flange sections 28 at the rear of the nozzle, and also the curvature of the diverter walls 88, can be extended on one side as indicated by phantom lines 96 in a total arc somewhat greater than 180°. Since the exterior surface of this extension slides against the inner cylindrical wall of the jet's rear body portion, essentially no water can flow past the rear of the jet and out the water conduit in the position of FIG. 7. A greater jet discharge is thus achieved, but at the cost of cutting off downstream jets. If downstream jet operation is also desired with this configuration, the upstream jet would be rotated to an intermediate position between FIGS. 7 and 8 to discharge some of the water through the jet, and transmit the rest of the water via bypass opening 21 to the downstream jet.

While particular embodiments of the invention have been shown and described, numerous variations and additional embodiments will occur to those skilled in the art. Accordingly, it is intended that the invention be limited only in terms of the appended claims.

We claim:

1. A two-axis rotatable hydrotherapy jet, comprising:

a jet housing, a water inlet to said housing, a water nozzle within said housing for forming water flowing through said inlet into a drive jet, a primary outlet rotatably mounted on said housing about a rotation axis for receiving said drive jet, said primary outlet having an orientation with respect to its rotation axis at which the flow of said drive jet through said primary outlet imparts a primary turning moment to said primary outlet that causes it to continuously rotate and to discharge a first stage jet along an outlet axis that continuously rotates relative to the rotation axis, and a secondary outlet rotatably mounted on said primary outlet about a second rotation axis to receive said first stage jet, said first stage jet imparting a secondary turning moment to said secondary outlet that causes it to continuously rotate relative to said second rotation axis and discharge a second stage jet.

2. The two-axis rotatable hydrotherapy jet of claim 1, wherein said primary outlet is mounted on said housing such that the orientation of its outlet axis with respect to its rotation axis is adjustable.

3. The two-axis rotatable hydrotherapy jet of claim 2, wherein said primary and secondary outlets rotate in first and second substantially circular patterns at respective speeds determined by said outlet-rotation axis orientation, the radius of the second circular pattern being less than the radius of the primary outlet's circular pattern.

4. The two-axis rotatable hydrotherapy jet of claim 3, wherein the secondary outlet is formed at an offset and non-parallel orientation with respect to the second rotation axis such that the first stage jet flowing through the secondary outlet imparts a turning moment that causes it to rotate at a greater speed than the primary outlet.

5. The two-axis rotatable hydrotherapy jet of claim 2, wherein the orientation of said primary outlet is adjustable with two degrees of freedom over a range of relative outlet-rotation axis orientations.

6. The two-axis rotatable hydrotherapy jet of claim 5, wherein the range of orientations includes a parallel orientation in which said outlet axis is offset from and in a substantially common plane with said primary outlet's rotation axis at which said primary outlet does not rotate.

7. The two-axis rotatable hydrotherapy jet of claim 6, wherein said primary outlet rotates in a substantially circular pattern at a rotational speed determined by said outlet-rotation axis orientation, the primary turning moment imparted by the drive jet and the rotational speed being a maximum when said primary outlet is oriented along a plane that is substantially perpendicular to said common plane.

8. The two-axis rotatable hydrotherapy jet of claim 7, wherein said housing includes a guide for adjusting the orientation of said primary outlet in both degrees of freedom to select the radius of the desired pattern and the desired speed.

9. The two-axis rotatable hydrotherapy jet of claim 8, wherein said guide has an asymmetrical clover pattern with a plurality of preset positions, and said primary outlet being adjustable to one of the preset positions or an intermediate position.

10. The two-axis rotatable hydrotherapy jet of claim 5, wherein said primary outlet comprises the ball portion of an eyeball-type outlet, and said housing comprises a rotatable socket capturing said ball portion, said ball and socket coupling providing the two degrees of freedom for orienting the primary outlet with respect to its rotation axis.

11. The two-axis rotatable hydrotherapy jet of claim 10, wherein the housing further comprises a ball bearing track on which said socket is mounted for allowing the rotation of said primary outlet about its rotation axis.

12. The two-axis rotatable hydrotherapy jet of claim 2, wherein said secondary outlet includes at least one conduit formed at an offset and non-parallel second outlet axis orientation with respect to said second rotation axis, said second stage jet being discharged along each conduit's outlet axis and rotating relative to the second rotation axis.

13. The two-axis rotatable hydrotherapy jet of claim 12, wherein said conduit's second outlet axis orientation is selected such that said first stage jet flowing through said conduit imparts said secondary turning moment to said secondary outlet that causes it to rotate at a greater speed than the primary outlet.

14. The two-axis rotatable hydrotherapy jet of claim 12, wherein said second rotation axis is substantially coaxial with said first outlet axis.

15. A two-axis rotatable hydrotherapy jet, comprising:

a jet housing including a socket of an eyeball-type outlet mounted on a ball bearing track that allows said socket to rotate, a water inlet to said housing, a water nozzle within said housing for forming water flowing through said inlet into a drive jet, a ball portion having a primary outlet with an outlet axis and captured in said socket for receiving said drive jet, the orientation of said primary outlet being adjustable with two degrees of freedom about a rotation axis so that it can be oriented with its outlet axis offset from and at a non-intersecting and non-parallel orientation with respect to its rotation axis, such that the flow of said drive jet through the primary outlet at said non-intersecting and non-parallel orientation imparts a primary turning moment to said ball portion that causes it to continuously rotate in a substantially circular pattern with a desired radius and to discharge a first stage jet along said outlet axis that continuously rotates relative to the rotation axis, and a secondary outlet rotatably mounted on said primary outlet about a second rotation axis to receive said first stage jet, said first stage jet imparting a secondary turning moment to said secondary outlet that causes it to continuously rotate in a substantially circular pattern with a fixed radius relative to said second rotation axis and discharge a second stage jet.

16. The two-axis rotatable hydrotherapy jet of claim 15, wherein said secondary outlet includes at least one conduit formed at an offset and non-parallel second outlet axis orientation with respect to said second rotation axis, said second stage jet being discharged along each conduit's outlet axis and rotating relative to the second rotation axis.

17. The two-axis rotatable hydrotherapy jet of claim 16, wherein said conduit's second outlet axis orientation is selected such that said first stage jet flowing through said conduit imparts said secondary turning moment to said secondary outlet that causes it to rotate at a greater speed than the primary outlet.

18. The two-axis rotatable hydrotherapy jet of claim 15, wherein said second rotation axis is substantially coaxial with said first outlet axis.

19. The two-axis rotatable hydrotherapy jet of claim 15, wherein said housing includes a guide for adjusting the orientation of said primary outlet in both degrees of freedom to select a rotation radius and a desired speed.

20. The two-axis rotatable hydrotherapy jet of claim 19, wherein said guide has an asymmetrical clover pattern with a plurality of preset positions with said primary outlet extending through said guide and being adjustable to one of the preset positions or an intermediate position.

* * * * *